United States Patent [19]

Mungons

[11] Patent Number: 4,884,587

[45] Date of Patent: Dec. 5, 1989

[54] AUXILIARY CANE OR CRUTCH DEVICE FOR HELPING TO LIFT LEGS OR FEET OR FOOT

[76] Inventor: Edwin M. Mungons, 719 Society Dr., Holiday, Fla. 43691

[21] Appl. No.: 107,022

[22] Filed: Oct. 13, 1987

[51] Int. Cl.[4] ..... A61H 3/00

[52] U.S. Cl. ..... 135/65; 135/66; 135/74; 248/218.4; 248/225.31

[58] Field of Search ..... 135/65–67, 135/74; 248/219.4, 218.4, 219.2, 225.31

[56] References Cited

U.S. PATENT DOCUMENTS

| | | | |
|---|---|---|---|
| 2,592,030 | 4/1952 | Harding | 248/219.4 |
| 2,642,074 | 6/1953 | Pedley et al. | 135/65 |
| 3,468,428 | 9/1969 | Reibold | 248/218.4 X |
| 3,738,674 | 6/1973 | Pauls | 135/66 X |
| 3,999,565 | 12/1976 | Delacour et al. | 135/65 |
| 4,274,430 | 6/1981 | Schaaf et al. | 135/65 |
| 4,771,972 | 9/1988 | Shaw | 248/218.4 X |

*Primary Examiner*—David A. Scherbel
*Assistant Examiner*—Lan Mai
*Attorney, Agent, or Firm*—George R. Royer

[57] ABSTRACT

The subject device is an auxiliary apparatus designed and structured to be appended to the lower part of a cane or crutch so that the user may have additional mechanical means to help lift his leg or foot with the aid of the crutch or cane. The device comprises in general an L-shaped frame member, the lower leg of which functions essentially as a stirrup upon which the foot can be placed, while the vertical is adapted, when so used, to be rested against the lower shank of the cane or crutch. An adjustable U-shaped collar is pivotally mounted to the upper leg of the L-shaped member serving to affix the L-shaped frame to the crutch shank. By pivotally mounting the L-shaped frame to the collar member, the L-shaped frame member can be pivotably moved to a position that is retracted upward out of the way when not in use.

4 Claims, 2 Drawing Sheets

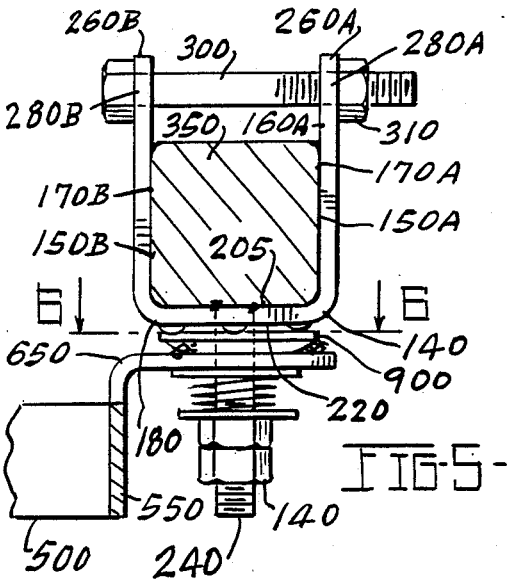
FIG-5-
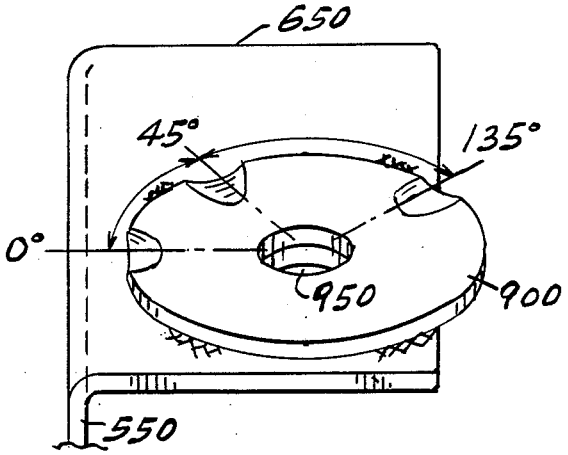
FIG-6-
FIG-7- FIG-8-
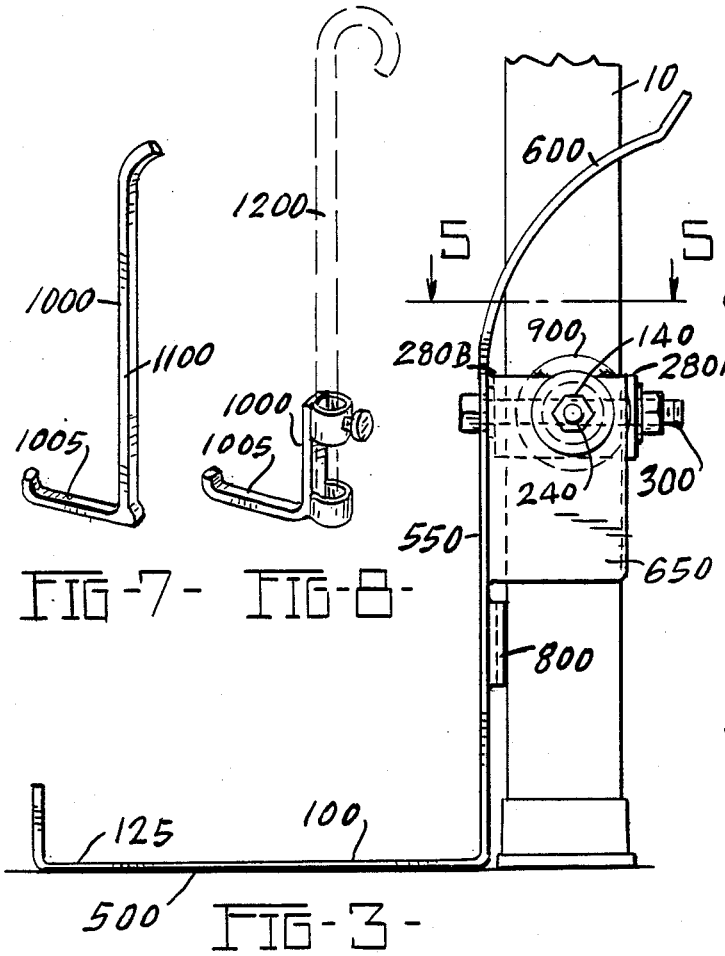
FIG-3-
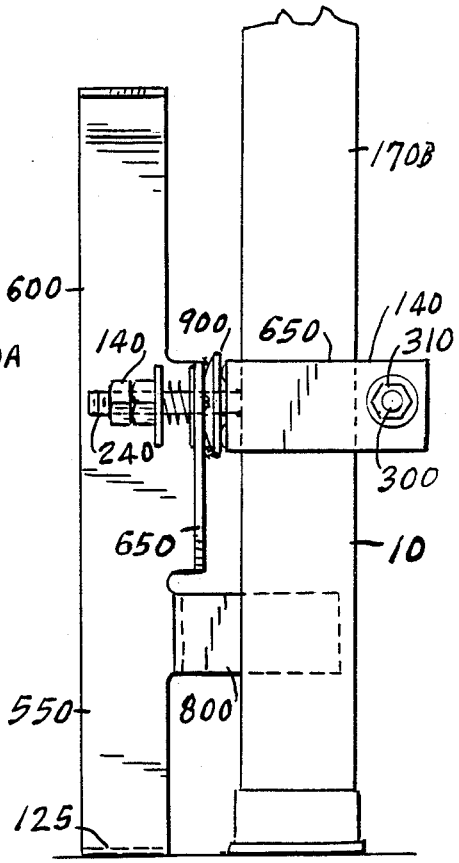
FIG-4-

AUXILIARY CANE OR CRUTCH DEVICE FOR HELPING TO LIFT LEGS OR FEET OR FOOT

DISCUSSION OF PRIOR ART AND BACKGROUND OF INVENTION

The subject invention is adapted to be appended to canes, crutches, and similar such devices for use in an auxiliary appendage to aid the user to lifting his leg, legs, foot or feet, such as in circumstances where the user is attempting to walk up stairs. Consequently, the subject invention falls within the general class of orthopedic devices, or walking aids.

In those circumstances where a person is compelled either temporarily or permanently to use a crutch or cane, maneuvering about is difficult enough on level surfaces. The difficulty of climbing stairs, with crutches, or getting about when one is required to lift the leg, is cumbersome, if not impossible for some.

Existing orthopedic devices adapted to help people get about generally includes conventional canes or crutches, and there are no known devices to help a user lift his legs, and the following invention is designed accordingly.

DRAWINGS In the drawings:

FIG. 3 is an end elevational view of the subject device;

FIG. 4 is a top elevational view of the attachment mechanism used to attach the subject device to the bottom of a cane or a similar device;

FIG. 5 is a perspective view of the stop mechanism used to control the movement of the subjece device;

FIG. 6 is an exploded perspective view of the subject device showing the arrangement of the subject device;

FIG. 7 is a perspective view of an alternate embodiment of the subject invention;

FIG. 8 is a view of the alternate embodiment of FIG. 7 as shown attached to the bottom of a cane.

DESCRIPTION OF GENERAL EMBODIMENT

The subject device is an auxiliary apparatus designed and structured to be appended to the lower part of a cane or crutch so that the user may have additional mechanical means to help lift his leg or foot with the aid of the crutch or cane. The device comprises in general an L-shaped frame member, the lower leg of which functions essentially as a stirrup upon which the foot can be placed, while the vertical is adapted, when so used, to be rested against the lower shank of the cane or crutch. An adjustable U-shaped collar is pivotally mounted to the upper leg of the L-shaped member serving to affix the L-shaped frame to the crutch shank. By pivotally mounting the L-shaped frame to the collar member, the L-shaped frame member can be pivotably moved to a position that is retracted upward out of the way when not in use.

DESCRIPTION OF PREFERRED EMBODIMENT

In describing the preferred embodiment of the subject invention, it is to be noted that the following description shall be of one embodiment only of several that are within the scope of the invention herein, and this description of a particular embodiment shall not be considered as limiting the scope of the invention herein. Moreover, in describing the subject invention, the following nomenclature shall be used. The word "upper" shall refer to those areas above the ground level, while the word "lower" will refer to those areas adjacent or near the ground level as appertaining to a vertically disposed cane or crutch member.

Figure 1:
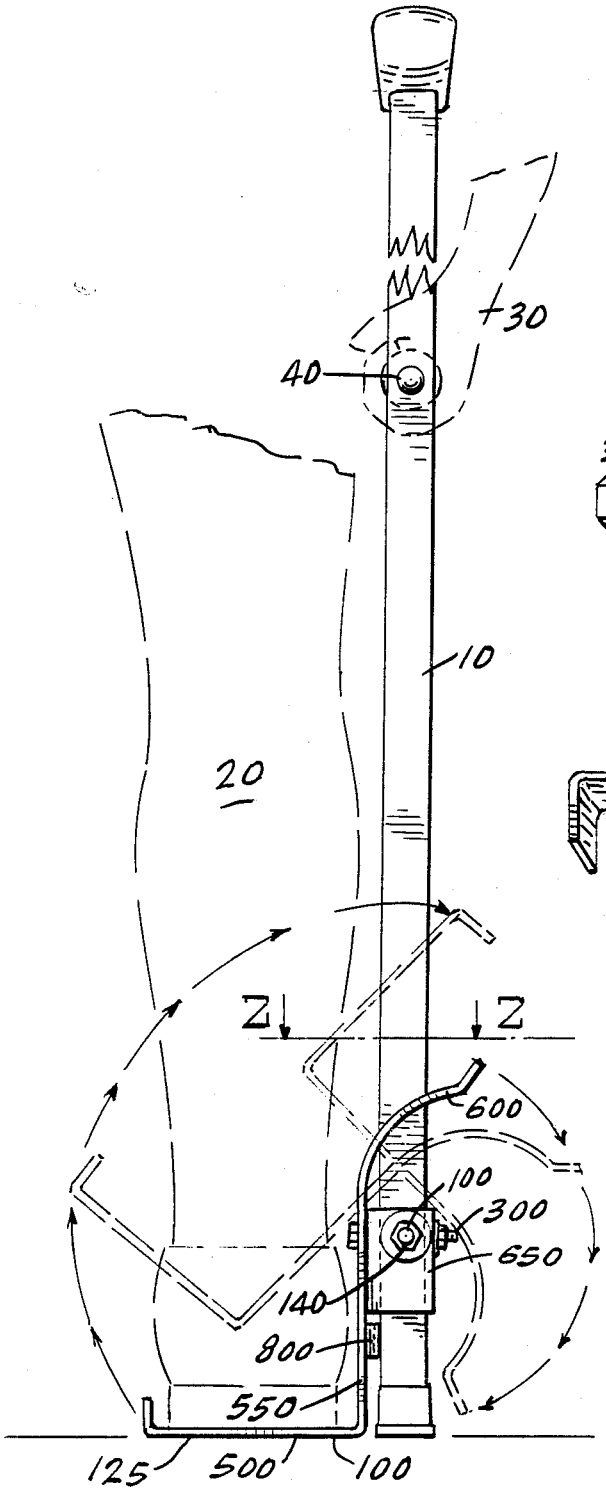
FIG. 1 is a side elevational view of the subject invention as appended to a cane.

Referring now to the drawings and particularly to FIG. 1, a vertically disposed crutch member 10 is adapted to be used as a vertically held auxiliary support member to be used in a conventional manner to help a person who is either temporarily or permanently disabled and needs such assistance in the walking process ascending a step or steps. As shown, the crutch 10, of a conventional construction, is schematically shown as being used by a person whose leg 20 is assisted in walking movement or ascending steps by the movement of the hand 30 on the handle 40 of crutch or cane member 10.

The construction of crutch member 10 is conventional in all respects except for the foot lift assist device 100 shown appended to the lower part 110 of the cane, as seen in FIG. 1. The use and constructional arrangement of the foot lift assist member 100 is described in detail below. It is to be noted that the foot assist member 100 can also be appended to the lower part of a cane, not shown, and basically structured and appended and structured in the same manner as described below.

Attention is again directed to FIG. 1 and in this latter view, the foot assist lifting member 100 is shown as being integrlly affixed to the lower part 110 of the crutch member 10. As can be seen from the drawings, and particularly FIG. 1, the foot lift assist member 10 (hereinafter referred to as "assist member 100") is basically, and generally comprised of a foot support 125 affixed in a pivotal fashion to a U-shaped frame attachment member 140 shown in FIG. 2. The latter attachment member is essentially a forked-shaped member with parallel arms 150A and 150B which arms are adapted to securely embrace a portion of opposing faces 160A and 160B of the lower part of the crutch member 100, as seen in the drawings, particularly FIGS. 1, 3 and 4.

Describing in more particular fashion, the assist member 100 is basically supported on and by the frame-attachment member 140 in a pivotal manner. In particular, the frame-attachment member 140 has all elements of the asist member 100 integrally appended thereto, as shown in the drawings.

The frame-attachment member 140, as stated, is comprised of a fork-like member 142, which in turn, has two parallel arms 150A and 150B, which are flat-faced members having inner faces 160A and 160B which are adapted to embrace a portion of the front and back faces 170A and 170B of the lower part of vertical shank of the crutch 10, as shown. The cross brace 180 on the support frame connects the adjacent ends of the parallel arms 150A and 150B with the cross brace being perpendicular to the parallel arm, as shown. In this latter constructional arrangement, the connecting part of the support frame is essentially formed of a U-shaped member that slides securely onto the crutch shank. In this respect it is preferable to construct the distances between the inner faces 160A and 160B of arms 150A and 150B so that such distance is just slightly greater than the width of the crutch shank. This latter aspect ensures a relatively secure clamping action of the frame support member about the crutch shank as shown in FIGS. 1, 3 and 4. When the parallel arms are fully placed about the crutch shank, as shown, the inner face of the cross member 180 embraces in a flush manner such that face 205 of the crutch shank that joins faces 170A and 170B of the loewr part of the crutch shank, as shown.

Figure 2:
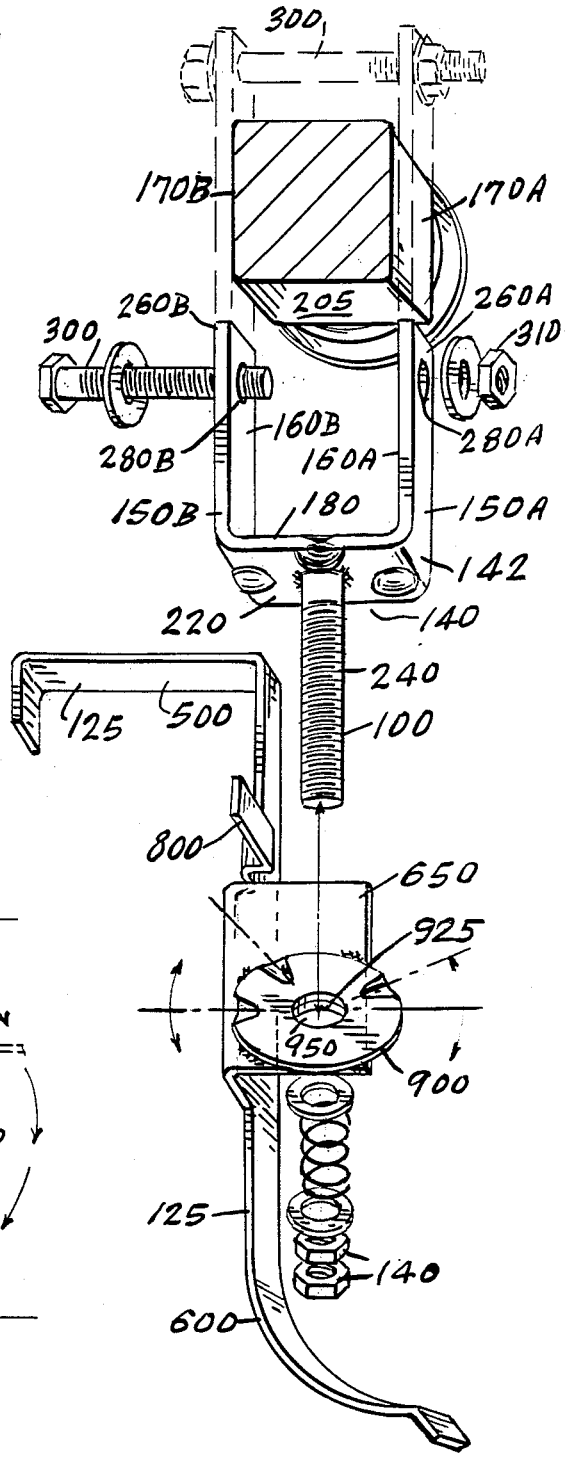
FIG. 2 is a side elevational view of the subject attachment device as shown appended to a cane or the bottom of a crutch.

As seen in FIG. 2, the outer face 220 of the cross shank member 180 has a longitudinally extending cylindrically shaped bolt member 240 of threaded disposition extending from face 220 in a perpendicular manner. The longitudinal projection of bolt member 240 is such that it lies horizontal or parallel to the ground whenever the crutch is in the vertical position as seen in the views of figures 3 and 4.

Reference is again made to FIGS. 2 and 5 of the drawings. As can be seen near the extreme ends 260A and 260B of the arms 150A and 150B on the frame support member have coaxially aligned circular bolt openings 280A and 280B formed therein, such openings being disposed along an imaginary transverse axis A—A as in FIG. 2 is mutually perpendicular to the planes of the inner faces 150A and 160B of the parallel arms on the frame support member. As can be determined, these bolt openings 280A and 280B are adapted to receive a longitudinal bolt member 300 with mating nut 310. As seen, the openings 280A and 280B are positioned strategically on the ends of the arms 150A and 150B so that the bolt 300 when inserted through such openings is spaced a slight distance beyond the face 350 of the crutch shank that opposes face 205 of the crutch shank. This bolt 300 serves to lock the arms 150A and 150B securely around the crutch shank to prevent either a wobbling, lateral movement or a vertically sliding movement up and down the crutch shank.

The support frame member as thusly described above serves as a stationary rigid support member about and on which the remaining moveable elements of the foot assist device are integrally affixed. In particular, as shown in FIGS. 3, 4 and 5, the foot support member 125 shown in the drawings as a substantially L-shaped member as viewed from the elevational view of FIG. 3.

Referring now to FIGS. 3, 4, 5 and 6 of the drawings. As can be seen from a review of the drawings, the L-shaped foot is comprised of a lower horizontally disposed leg 500, which leg is adapted to rest flush against the ground when the L-shaped foot rest is in the protracted down position, as shown in FIGS. 1 and 3. As can be seen, the vertical or upright leg 550 of the L-shaped foot rest is generally and substantially a straight member having the optional feature of a curved upper portion 600, which is adapted primarily to assist the user in moving or rotating the foot rest to a rotated position moving clockwise to that position shown in phantom in FIG. 1. This latter position can be considered the storage position when the footrest is not needed.

As shown in FIGS. 1, 3, 4 and 5, vertical leg 550 has a transverse flanged plate extension 650 at approximately the middle of said vertical leg,such flanged plate extension being perpendicular to the plane formed by the opposing surfaces of the vertical leg. This flanged plate, in turn, has a transverse bore 700 machined through it, as seen in FIG. 2. The bolt member 240 shown in FIG. 2 which is integrally affixed to the cross brace member 180, as seen, is inserted through the bore opening 700. By this latter constructional arrangement, the flanged plate 650 and thus the foot rest member is adapted to rotate about the bolt member in a plane which is basically perpendicular to the ground.

Again, in reference to FIGS. 1, 2, 3 and 4, disposed on the vertical leg of the foot assist member is a second flanged extension 800. Second flanged extension 800 is perpendicular to the first flanged member as shown, and in this respect, such second flanged extension functions as a stop or a catch against the bottom outer surface of the crutch shank in order to prevent the now rotatably mounted foot rest member from rotating beyond the position shown in FIG. 1.

In the embodiment shown in the drawings, particularly FIGS. 2 and 6, a circular rotation control plate 900 is affixed to that surface of the first perpendicular flange that abuts or faces towards the cross brace member 180, as shown in FIG. 2. More specifically, the circular rotation control plate has centrally disposed transverse bore 950 which bore is aligned concentrically over the bore 925 in the first flanged plate, so that the circular central plate is flush against the adjoining face of the first flanged plate member 650. The circular control plate is then affixed, by welding or otherwise, to the first flanged plate member so that it is immovable relative thereto. As can be seen in FIG. 6 the circular control plate 900 has a series of detents adjacent its outer circumference to permit the control plate to provide measured and semi-restricted movement of the L-shaped leg relative to the fixed bolt member.

Exhibit A

More specifically, referring again to the drawings and particularly FIGS. 2, 5 and 6, the circular rotation control plate 900, having an upper surface and a lower surface, that is affixed to the surface of the first perpendicular flange plate 650, as described above, is generally a circular member, relatively flat member, which has a centrally disposed circular bore 950. This latter bore 950, as stated, is adapted to be concentrically and coaxially aligned with the bore 925 in the first flanged plate member 650. Moreover, the circular control plate 900 is affixed in a flush manner against the first perpendicular flange plate 650, such that the lower surface of such control plate 900 rests flush against the adjoining surface of such flanged plate 650. The lower surface of the control plate 900 is then rigidly affixed to the adjoining surface of the adjoining surface of such flanged plate member 650 by a welding or other similar joinder process. This process of affixing such control plate 900 to the flange plate 650 causes the control plate 900 to be immovable and thus fixed to the flanged plate 650.

As can be seen in the drawings, the control plate has three detents 2000A, 2000B, and 2000C, which detents are emplaced in a spaced apart relationship around the outer circumferential periphery of such control plate 900. As can be seen in FIG. 6, the first detent is spaced in a position that is aligned along an imaginary axis that is aligned in a manner or alignment that is perpendicular to the linear edge that intersects leg 550 and the upper surface of flange plate 650. The second depressed detent 2000B is situated at a point which is forty-five degrees clockwise from the first detent 2000A, while the third detent 2000C is located at a position which is one hundred and thirty-five degrees clockwise from the first detent 2000A.

The control plate 200 is sandwiched between the upper surface of flanged plate 650 and the surface 220. The detents that are on the bottom of the surface 220 serve to catch one of the detents so as to control the motion of the control plate 200 and the arm 125.

In summary the subject device is an auxiliary device for attachment to a crutch or a cane having a vertical shank used to aid a person to ambulate with said auxiliary device adapted to assist the cane or crutch user to raise the lower part of the leg and comprises a rigid frame member wherein the frame member is adapted to embrace the shank of the crutch with a foot rest member being affixed on said frame member.

As shown in FIGS. 7 and 8, analternate embodiment of the subject invention is shown which is adapted to be affixed to a cane 1200, shown in phantom in FIG. 8. An L-shaped assist device 1000 incorporating the features of the subject invention is shown with a horizontal foot rest 1005 affixed in perpendicular fashion to the vertical shank 1100 of the assist device 1000. As shown the vertical shank is affixed to cane through intermediate connecting means, as shown in FIGS. 7 and 8.

We claim:

1. An auxiliary device for attachment to a crutch having a vertical shank used to aid a person to ambulate with said auxiliary device adapted to assist the crutch user to raise the lower part of the leg which is adjacent to the crutch; said device comprising:

(a) a rigid support frame member comprises of a base cross brace member, said base cross member having parallel arms extending in a perpendicular manner from the respective ends of the base cross brace member, having an inner and outer face, and which parallel arms are adapted to fixedly embrace the vertical shank of the crutch;

(b) secondary support means affixed in a perpendicular manner to the outer face of the cross brace member, said secondary support means, projecting in a direction opposite to that of parallel arms;

(c) a foot assist member pivotally mounted on said secondary support bolt means on said support frame, said foot assist member adapted to pivotably rotate on said frame member;

(d) circulate control plate means connected to said foot assist member and mounted on said secondary support means having a circumferential periphery with said periphery having a plurality of indentations therein, said control plate means being adapted to control the pivotal movement of said foot assist member.

2. An auxiliary device for attachment to a crutch having a vertical shank used to aid a person to ambulate with said auxiliary device adapted to assist the crutch user to raise the lower part of the leg which is adjacent to the crutch; said device comprising:

(a) a rigid frame member adapted to fixedly embrace the vertical shank of the crutch affix thereby support said frame member to the crutch shank;

(b) support means rigidly affixed in a perpendicular manner to said rigid frame member, projecting in a direction away from the crutch shank;

(c) a foot assist member pivotally mounted on said secondary support means on said support frame, said foot assist member comprising an L-shaped member with a horizontal leg that is adapted to be parallel to the ground.

(d) ciculate control plate means connected to said foot assist member and mounted on said support means having a circumferential periphery with said periphery having a plurality of indentations therein,said control plate means being adapted to control the pivotal movement of said foot assist member.

3. An auxiliary device for attachment to a cane having a vertical shank used to aid a person to ambulate with said auxiliary device adapted to assist the cane user to raise the lower part of the leg which is adjacent to the cane; said device comprising:

(a) a rigid frame member, said frame member being adapted to embrace the vertical shank of the cane;

(b) a foot assist member affixed on said frame member, said foot assist member having a base portion for the foot to rest upon, said foot assist member comprising an L-shaped member that has a horizontal base leg;

(c) circulate control plate means connected to said foot assist member and mounted on said rigid frame member having a circumferential periphery with said periphery having a plurality of indentations therein, said control plate means being adapted to control the pivotal movement of said foot assist member.

4. An auxiliary device for attachment to a crutch having a vertical shank used to aid a person to ambulate with said auxiliary device adapted to assist the crutch user to raise the lower part of the leg which is adjacent to the crutch; said device comprisng:

(a) a rigid support frame member comprised of a base cross brace member, having an outer face and an inner face, said base cross member having parallel arms extending in a perpendicular manner from the respective end of the inner portion of the base cross brace member, having an inner and outer face; and which parallel arms are adapted to fixedly embrace the vertical shank of the crutch, said parallel arms having directly opposing bolt openings in each of said parallel arms ;

(b) bolt means adapted to be inserted through each of the opposing bolt openings in each of the parallel arms to lock said arms around the crutch shank;

(c) secondary support means affixed in a perpendicular manner to the outer face of said cross brace member, said secondary support means, projecting in a direction opposite to that of parallel arms;

(d) a foot assist member pivotally mounted on said secondary support means on said support frame ;

(e) circulate control plate means connected to said foot assist member and mounted on said secondary support means having a circumferential periphery with said periphery having a plurality of indentations therein, said control plate means being adapted to control the pivotal movement of said foot assist member.

* * * * *